US011703308B2

(12) United States Patent
Ding et al.

(10) Patent No.: US 11,703,308 B2
(45) Date of Patent: Jul. 18, 2023

(54) FIREARM RAIL MOUNT AND RELATED METHOD OF USE

(71) Applicant: Leapers, Inc., Livonia, MI (US)

(72) Inventors: Tai-lai Ding, Northville, MI (US); Tat Shing Yu, Plymouth, MI (US)

(73) Assignee: Leapers, Inc., Livonia, MI (US)

( * ) Notice: Subject to any disclaimer, the term of this patent is extended or adjusted under 35 U.S.C. 154(b) by 228 days.

(21) Appl. No.: 17/140,576

(22) Filed: Jan. 4, 2021

(65) Prior Publication Data

US 2022/0214142 A1 Jul. 7, 2022

(51) Int. Cl.
*F41G 11/00* (2006.01)

(52) U.S. Cl.
CPC ..... *F41G 11/003* (2013.01)

(58) Field of Classification Search
CPC ..... F41G 11/003
See application file for complete search history.

(56) References Cited

U.S. PATENT DOCUMENTS 3,877,166 A * 4/1975 Ward ..... F41G 11/003 42/127
5,155,915 A * 10/1992 Repa ..... F41G 11/003 42/129
5,680,725 A * 10/1997 Bell ..... F41G 11/003 42/127
6,442,883 B1 * 9/2002 Waterman ..... F41G 11/003 42/124
6,637,144 B2 * 10/2003 Nelson ..... F41G 1/35 42/120
6,931,778 B1 * 8/2005 Nelson ..... F41G 1/35 42/120
7,685,759 B2 3/2010 Teetzel
7,757,422 B1 * 7/2010 Swan ..... F41C 23/16 403/374.5
8,336,247 B2 * 12/2012 Haering ..... F41G 11/003 42/111
8,438,965 B2 * 5/2013 Collin ..... F41G 11/003 89/125

(Continued)

FOREIGN PATENT DOCUMENTS

EA 028635 B1 12/2017
RU 100599 U1 12/2010

(Continued)

*Primary Examiner* — Michelle Clement
(74) *Attorney, Agent, or Firm* — Warner Norcross + Judd LLP

(57) ABSTRACT

An accessory mount for removably attaching an accessory to a firearm rail includes a base having a mounting rail, a lock block moveable in a recess of the base and a throw lever, which when activated, allows springs to move the lock block in the recess so the lock block disengages the firearm rail in an open mode. The thumb lever also can engage the lock block to a closed mode in which it clamps the mount to the firearm rail in a fixed position relative to the firearm. An accessory thus can be firmly, consistently and securely mounted relative to the firearm with the mount. The thumb lever can be joined with a threaded shaft that engages a threaded element, for example, a keps nut, associated with the lock block. A toggle lock can selectively engage notches in the threaded element to set the overall clamping force of the lock block and mount on the firearm rail.

20 Claims, 8 Drawing Sheets

(56) References Cited

U.S. PATENT DOCUMENTS 8,707,606 B2 * 4/2014 Hoel ..... F41G 11/003 42/124
8,769,859 B2 * 7/2014 Li ..... F41G 11/003 42/124
8,806,796 B1 * 8/2014 Clifton ..... F41G 11/003 42/127
8,935,875 B2 * 1/2015 Collin ..... F41G 11/003 42/124
9,297,616 B2 * 3/2016 Daniel ..... F41G 11/004
9,568,281 B1 * 2/2017 Chen ..... F41A 23/10
10,132,596 B2 * 11/2018 Bartoszewicz ..... F41G 11/003
10,371,317 B2 * 8/2019 Chen ..... F16M 13/022
10,578,404 B2 * 3/2020 Swan ..... F41G 11/003
10,670,369 B1 * 6/2020 Ding ..... F41A 3/66
10,801,814 B2 * 10/2020 Ma ..... F41G 11/003
10,895,436 B2 * 1/2021 Ross ..... F41G 11/004
10,955,221 B2 * 3/2021 Duncan, III ..... F41G 11/003
11,085,736 B2 * 8/2021 Johnson, Sr. ..... F41G 11/003
D949,276 S * 4/2022 Ding ..... D22/109
2007/0234623 A1 * 10/2007 Carney ..... F41G 11/004 42/95
2008/0178511 A1 * 7/2008 Storch ..... F41C 27/00 42/90
2011/0058362 A1 * 3/2011 Sun ..... F41G 1/35 362/187
2011/0067287 A1 * 3/2011 Collin ..... F41G 11/003 42/90
2011/0146128 A1 * 6/2011 Haering ..... F41G 11/003 42/90
2011/0247255 A1 * 10/2011 Ding ..... F41G 11/003 42/90
2012/0167438 A1 * 7/2012 Daniel ..... F41G 11/004 29/525.08
2012/0198745 A1 * 8/2012 Riley ..... F41C 27/00 42/90
2013/0156495 A1 * 6/2013 Li ..... F16B 2/12 403/322.4
2013/0160345 A1 * 6/2013 Li ..... F41G 11/003 42/111
2014/0082985 A1 * 3/2014 Larue ..... F41A 35/00 42/90
2014/0137457 A1 * 5/2014 Collin ..... F41G 11/003 42/90
2014/0196348 A1 * 7/2014 Samson ..... F41G 11/004 42/90
2015/0362291 A1 * 12/2015 Samson ..... F41G 11/004 29/428
2016/0202022 A1 * 7/2016 Gao ..... F41G 11/003 42/90
2017/0045334 A1 * 2/2017 Yim ..... F16M 11/041
2018/0259298 A1 * 9/2018 Gao ..... F16B 2/18
2018/0340754 A1 * 11/2018 Cosentino ..... F41G 11/003
2018/0347950 A1 * 12/2018 Swan ..... F41G 11/003
2019/0162362 A1 * 5/2019 Chen ..... F16M 11/041
2019/0219365 A1 * 7/2019 Ma ..... F41G 11/003
2019/0285386 A1 * 9/2019 Burt ..... F41G 11/006
2019/0331460 A1 * 10/2019 Johnson, Sr. ..... F41G 11/003
2020/0025522 A1 * 1/2020 Zimmer ..... F41G 11/001
2021/0140743 A1 * 5/2021 Chen ..... F41G 11/003
2021/0223003 A1 * 7/2021 Morrison ..... F41G 11/003
2021/0293512 A1 * 9/2021 Duncan, III ..... F41G 11/003
2021/0325149 A1 * 10/2021 Johnson, Sr. ..... F41G 11/003
2022/0163292 A1 * 5/2022 Kilic ..... F41G 1/387
2022/0214142 A1 * 7/2022 Ding ..... F41G 11/003

FOREIGN PATENT DOCUMENTS

RU 2521853 C1 7/2014
RU 2541297 C1 2/2015
RU 152962 U1 6/2015
RU 174865 U1 11/2017

* cited by examiner

FIREARM RAIL MOUNT AND RELATED METHOD OF USE

BACKGROUND OF THE INVENTION

The present invention relates to firearms, and more particularly to a rail mount for mounting an accessory to a firearm.

Many modern sporting and military firearms include a rail system designed to mount accessories, such as scopes, reflex sights, lights, lasers and the like to the firearm. A popular type of rail system is the picatinny rail system. Most present accessories are designed to mount to such a rail system with ease. Some firearms, however, do not have good mounting systems, let alone a picatinny rail system commonly mounted to them. One such firearm is the Kalashnikov gas rifle, better known as the AK-47, and its variants, which comprise one of the largest groups of firearms in the world. The AK-47 rifles, as well as some other variants, have a wedge shaped rail on the side of the receiver, with no rail mounted on the top of the firearm due to a dust cover located there.

Some manufacturers have developed mounts that extend up from this wedge rail on the side of such weapons. These mounts include a picatinny rail that extends over the top of the receiver so that an accessory can be mounted there. A popular type of side rail mount is the UTG Pro Quick Detachable AK Side Mount, available from Leapers, Inc. of Livonia, Mich. This mount offers a top rail that extends over the top of the firearm receiver and positioned well for further mounting of optics and other accessories along a line of sight over the top of the receiver. This mount also has quick detach capability implemented via a throw lever. Tightening the throw lever bends a rail part that clamps against the wedge rail of the firearm to secure the mount to the same. While this provides exceptional grip and attachment to the rail, it can sometimes be difficult and time consuming to precisely tighten the lever a desired amount. The rail mount also grips the wedge rail in a localized, curved area where the rail part bends, which might not distribute the clamping force widely enough in some cases.

Accordingly, there remains room for improvement in the field of rail mounts to secure accessories to rails of firearms.

SUMMARY OF THE INVENTION

A mount for removably attaching accessories to a firearm is provided. The mount can include a base having a mounting rail, a lock block moveable in a recess of the base and a throw lever, which when activated, allows springs to move the lock block in the recess so the lock block disengages the firearm rail in an open mode.

In one embodiment, the thumb lever can engage the lock block to a closed mode in which it clamps the mount to the firearm rail in a fixed position relative to the firearm. An accessory thus can be firmly, consistently and securely mounted relative to the firearm with the mount for use by a user.

In another embodiment, the thumb lever can be joined with a threaded shaft that engages a threaded element, for example, a keps nut, associated with the lock block. The keps nut can have a head with multiple notches, and a sleeve that extends into a bore defined by the lock block. The sleeve can include threads that threadably engage the threaded shaft so that as the threaded shaft is rotated, the threaded element can thread off the shaft. The springs can thus move the lock block in the recess to release the lock block from the firearm rail.

In still another embodiment, the mount can include a lock element, for example, a toggle lock. The toggle lock can be mounted adjacent the threaded element, and can be selectively moveable in and out of a particular notch of the threaded element when that notch is aligned with the lock element. As a result, the toggle lock can engage and lock with the threaded element so that it will not rotate in a locked mode. When the threaded shaft rotates in the threaded element, the threaded element threads off the shaft, and as noted above, the springs can thus move the lock block in the recess to release the lock block from the firearm rail so that the mount can be removed therefrom.

In yet another embodiment, the mount includes a ledge joined with the base and disposed adjacent the thumb lever when the lock block is in the closed mode. The mount can include a ball catch that engages the thumb lever to secure the thumb lever in a retracted mode when the lock block is in the closed mode. The ball catch can include a ball and another spring associated with the ledge to activate the ball.

In even another embodiment, the mount can be configured to engage a firearm rail located on a lateral side of the firearm, for example, on a lateral side of a receiver. The mount can include an L-shaped leg extending upward from the base. The leg can be configured to extend over a portion of the firearm. The accessory mounting rail can be joined with an upper portion of the leg so that the accessory rail extends along a longitudinal axis of the firearm.

In a further embodiment, the lock block includes a first block guide and a second block guide disposed at opposing ends of the lock block. The first guide block guide registers with a corresponding first base guide, and the second block guide registers with a corresponding second base guide. Both base guides can be associated with the base. The first and second block guides registered with the first and second base guides can align the lock block in the recess so that the lock block can slide within the recess in an aligned, consistent, relatively linear, nonbinding and/or smooth manner.

In a still a further embodiment, a method of using the mount is provided. The method can include: providing a base joined with an accessory mounting rail, the base defining a recess with a lock block movably disposed in the recess, the lock block defining a bore within which a threaded element is selectively, rotatably constrained; rotating a thumb lever joined with the base so that a threaded shaft, joined with the thumb lever, rotates relative to the threaded element; an urging the lock block away from a firearm rail via a spring so that the mount can be detached from the firearm rail in an open mode.

In yet a further embodiment, the method can include locating the threaded element between the bore and the threaded shaft so that the threaded shaft does not directly engage the lock block.

In even a further embodiment, the method can include engaging a toggle lock with a notch of the threaded element so that the threaded element is rotatably constrained in the bore, unable to rotate. In some cases, the toggle lock includes a nose that projects into a particular notch so that the threaded element cannot rotate.

The current embodiments of the mount and related method of use provide benefits above that previously have been unachievable. These and other objects, advantages, and features of the invention will be more fully understood and appreciated by reference to the description of the current embodiment and the drawings.

These and other objects, advantages, and features of the invention will be more fully understood and appreciated by reference to the description of the current embodiment and the drawings.

Before the embodiments of the invention are explained in detail, it is to be understood that the invention is not limited to the details of operation or to the details of construction and the arrangement of the components set forth in the following description or illustrated in the drawings. The invention may be implemented in various other embodiments and of being practiced or being carried out in alternative ways not expressly disclosed herein. Also, it is to be understood that the phraseology and terminology used herein are for the purpose of description and should not be regarded as limiting. The use of "including" and "comprising" and variations thereof is meant to encompass the items listed thereafter and equivalents thereof as well as additional items and equivalents thereof. Further, enumeration may be used in the description of various embodiments. Unless otherwise expressly stated, the use of enumeration should not be construed as limiting the invention to any specific order or number of components. Nor should the use of enumeration be construed as excluding from the scope of the invention any additional steps or components that might be combined with or into the enumerated steps or components.

DESCRIPTION OF THE CURRENT EMBODIMENTS

Figure 1:
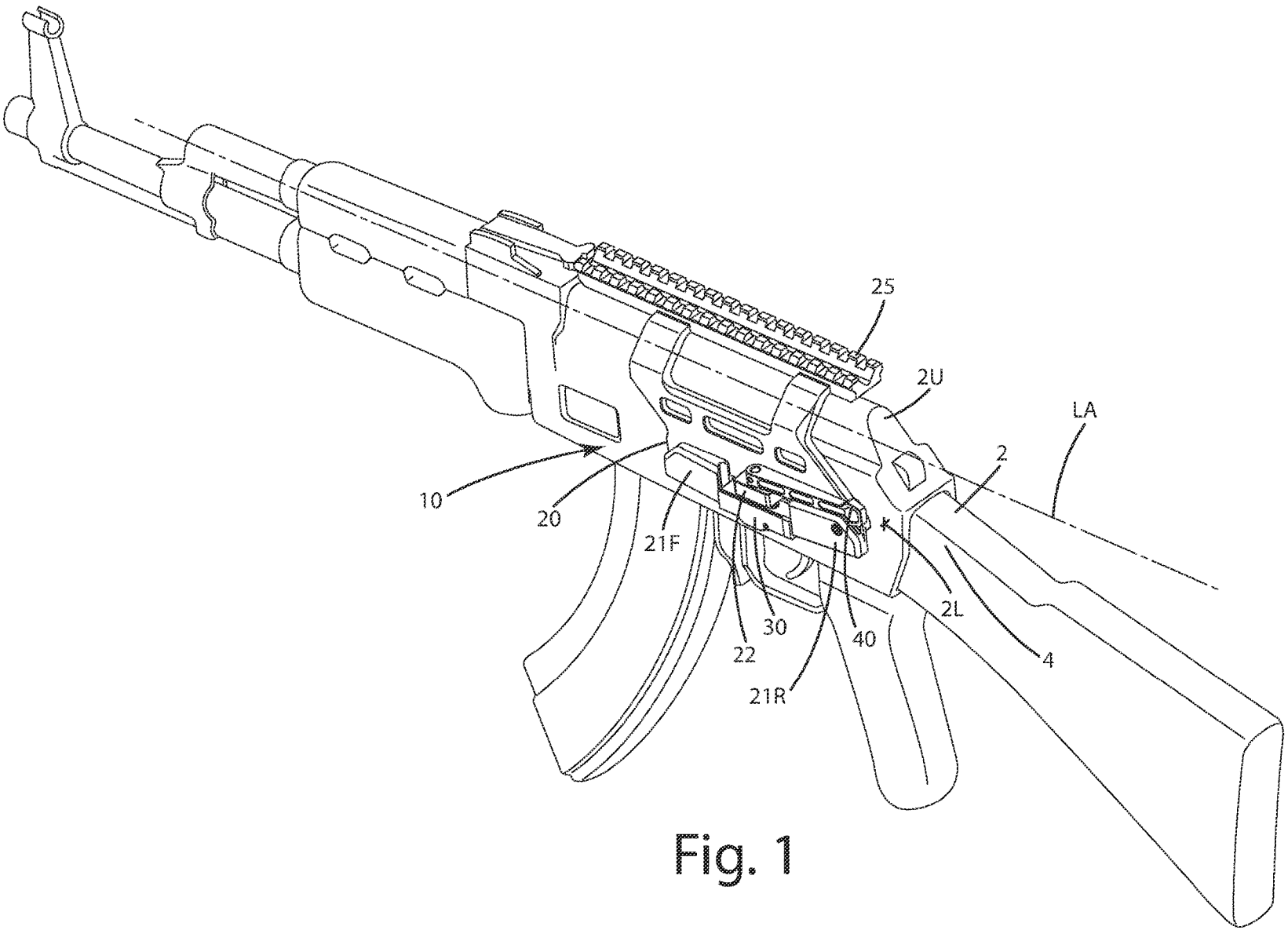
FIG. 1 is a rear perspective view of a mount of a current embodiment mounted on a lateral firearm rail of a firearm such that a mounting rail projects over an upper portion of the firearm, with the lock block in a closed mode securing the mount to the firearm rail.

A current embodiment of the mount is illustrated in FIGS. 1-8 and generally designated 10. The mount 10 can be used to mount a variety of different accessories to the firearm. The accessories can include, but are not limited to, optical scopes, reflex sights, red dots, lighting systems, aiming lasers, iron sights, bipods, cameras, and virtually any other rail mounted accessory. The mount 10 is configured to be secured to the weapon 2 via a firearm rail 3 that is fixedly secured to or integrated with the weapon. Where the weapon 2 is a firearm, such as the exemplary, shown AK-47 style rifle or variant thereof, the mount 10 can be configured to join with a laterally disposed firearm mounting rail, or firearm rail 3. The mount can also be used with an upper or lower mounted firearm rail. The mount can be used with any type of firearm, such as shotguns, handguns, artillery weapons, as well as archery devices, such as compound bows and crossbows or other projectile shooting devices.

The firearm rail 3 can be disposed on a lateral side 2L of the receiver 4 of the weapon 1. In this configuration, a base 20 of the mount extends along the lateral side 4L of the receiver, and a leg 27 extends upward from the base, along the lateral side, angling or curving over an upper portion 2U of the weapon or firearm. This leg 27 can be generally L-shaped as shown. The mount can include an accessory mounting rail 25, which can be a longitudinal rail as shown. The rail 25 described herein is a picatinny rail, however, any other type of rail or mounting structure is contemplated to be compatible with the mount 10. The rail can extend generally along, parallel to and or transverse to the longitudinal axis LA of the firearm. Further, although shown as attaching to a side or lateral firearm rail, the mount 10 herein can be used in other applications, where the mount 10 and its accessory rail 25 is mounted atop the weapon, over a receiver 3 or an upper portion 2U of the weapon 2.

Figure 2:
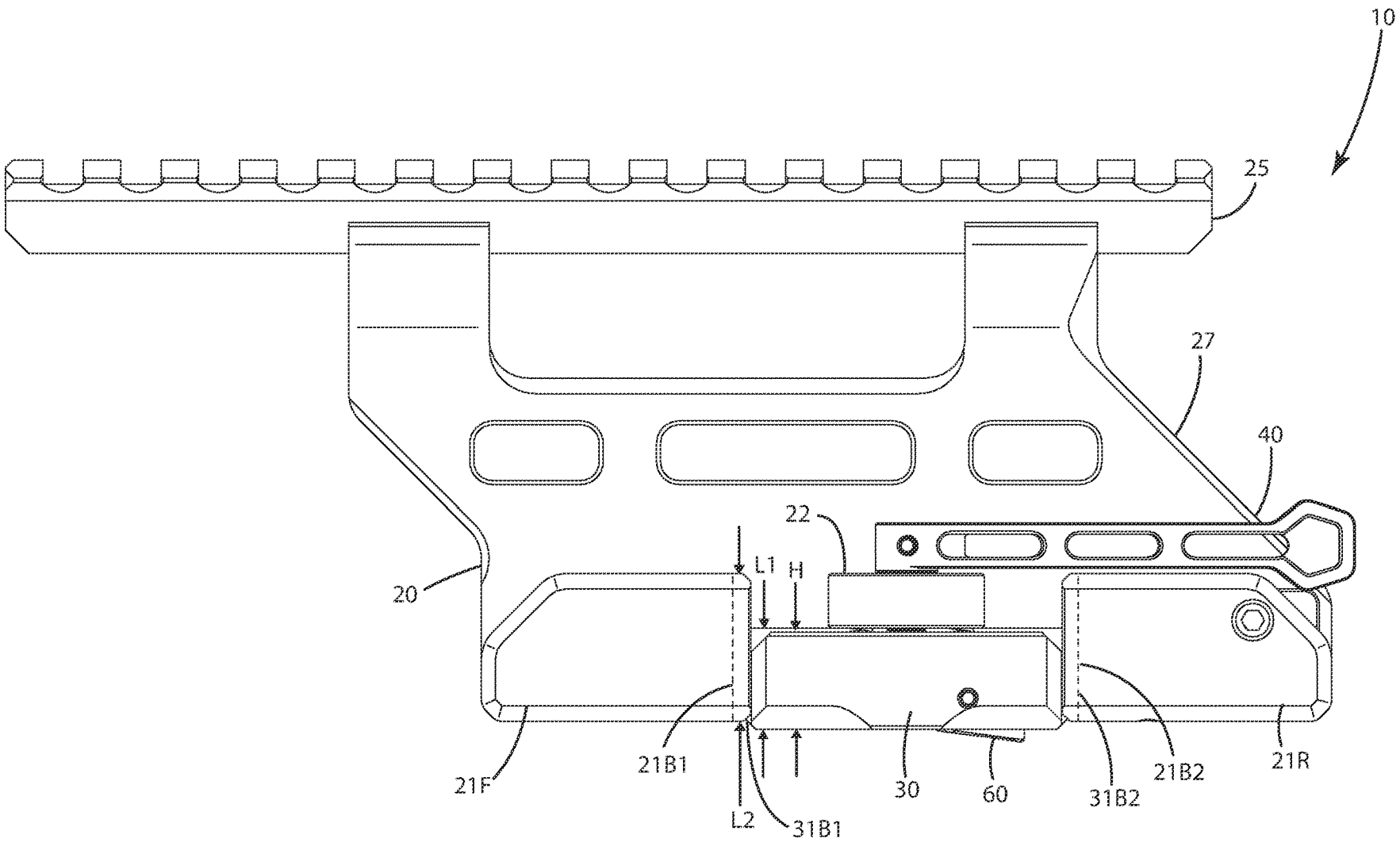
FIG. 2 is a side view of the mount with the lock block in a closed mode securing the mount to the firearm.
Figure 3:
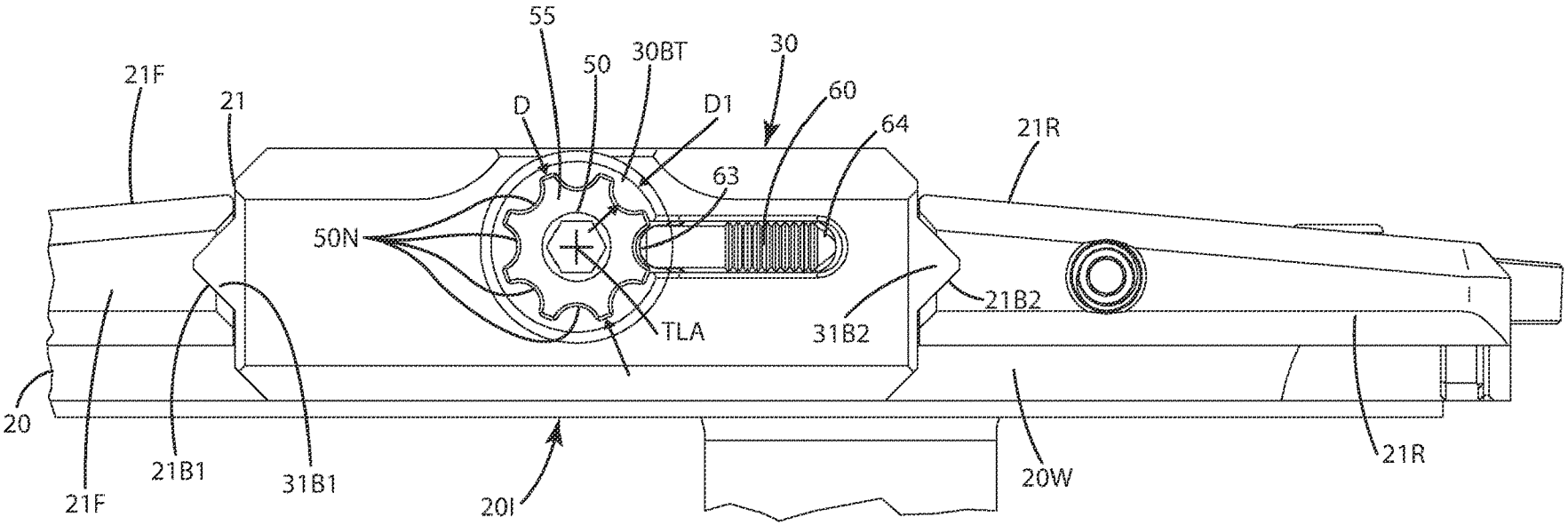
FIG. 3 is a bottom view of the mount showing a threaded element and a toggle lock in a locked mode so the threaded element does not rotate in the lock block.

With reference to FIG. 1, the mount 10 includes a base 20 defining a recess 21 and a lock block 30 movably mounted in the recess or relative to the base. The mount further includes a thumb lever 40 which can allow the lock block to move relative to the base and any firearm rail 3 to which the mount is secured. Turning to FIGS. 2-3, the base can define the recess generally between forward 21F and rearward 21R parts. The forward part 21F can include a first base guide 21B1 and the rearward part 21R can include a second base guide 21B2. These base guides optionally can be grooves, recesses, channels, slots as shown, or alternatively can be pyramidal structures, triangular structures, contours, projections, raised areas or the like.

As shown, these base guides can interface with and guide the lock block 30 in the recess 21. More particularly, the lock block can include a first block guide 31B1 and a second block guide 31B2 at opposing ends or opposing sides thereof. The first block guide can be at the forward part of the lock block, and can slidably or movably fit, register and/or interface with and/or relative to the first base guide. The second block guide can be at the rearward part of the lock block and can slidably or movably fit, register and/or interface with and/or relative to the second base guide. The block guides can extend from the top of the lock block to its bottom, through its height H, or can be smaller and shorter, depending on the application. Optionally, the block guides can have a length L1 that is equal to or shorter than the height, and that can be shorter than a length L2 of the base guides. The block guides optionally can be pyramidal structures, triangular structures, contours, projections, raised areas or the like as shown, or alternatively can be grooves, recesses, channels or slots. In some cases the structures of the base guides and the block guides can be reversed. Whatever the structure of the base and block guides, the first and second block guides registered with the first and second base guides can align the lock block 30 in the recess 21 so that the lock block can slide, transition or otherwise move within the recess in an aligned manner therewith. The tolerances between the block and base guides can be close and minimal so that the lock block does not bind, tilt or lock up when moving relative to the recess via the springs as described below or other movement input.

Figure 4:
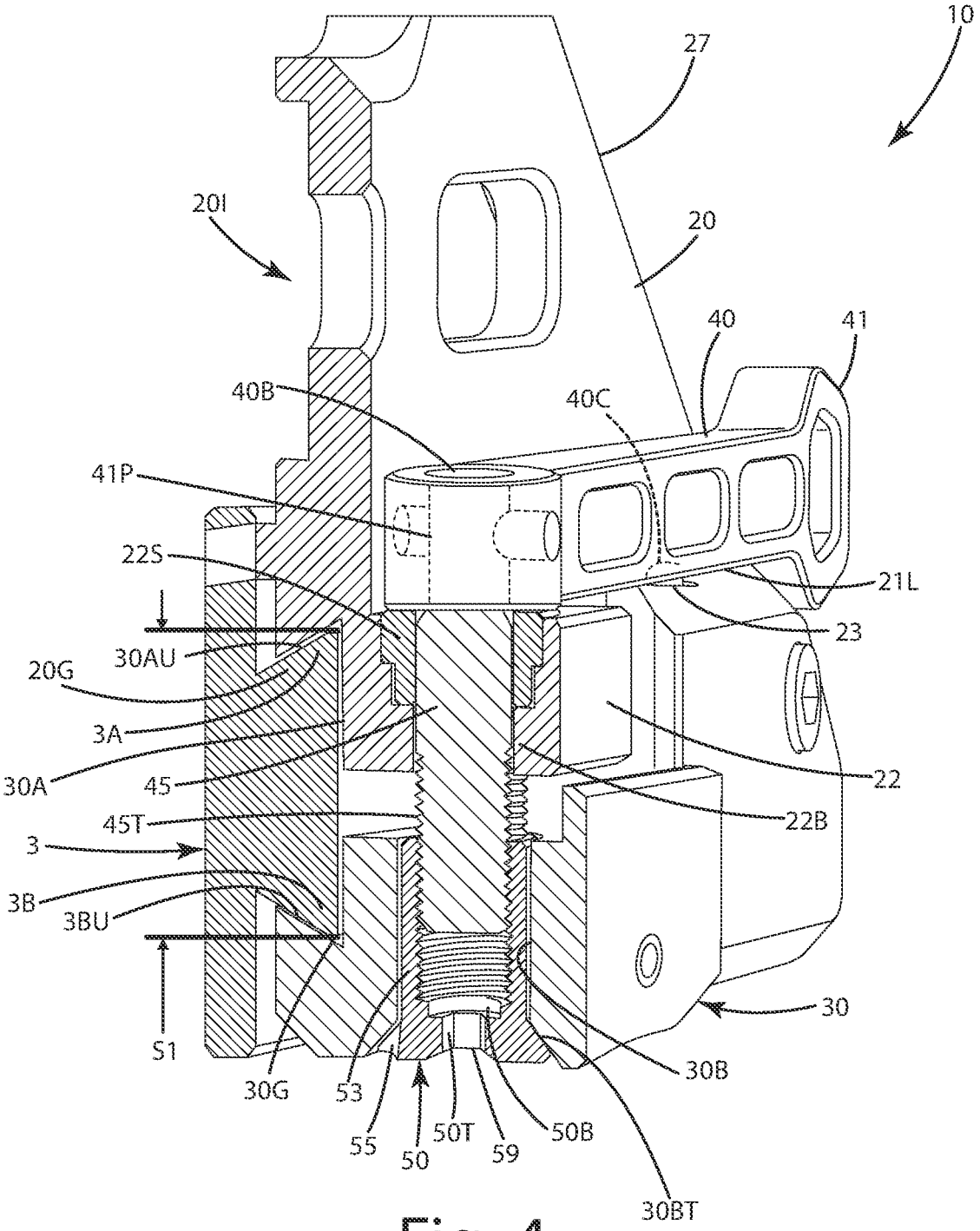
FIG. 4 is a section view of the lock block and base engaging a firearm rail in a closed mode to secure the mount to the firearm rail in a secure manner.

As mentioned above, the base can include forward and rearward parts 21F and 21R. As shown in FIGS. 1-4, a pivot region or block 22 can be disposed, and can be aligned over or in the recess 21, optionally between the front and rearward parts, and/or between the base guides. The pivot block 22 can extend outward from the base 20 as shown in FIG. 4. The pivot block also can define a shaft bore 22B extending through the block 22. The shaft bore can be vertical as shown, or in other applications, horizontal. The shaft bore can be sized to receive a bushing 22S and a portion of a threaded shaft 45, which can be partially threaded as shown or fully threaded. The bushing 22S can facilitate rotation of the shaft 45 in the pivot block. Optionally, the bushing can be removed in some applications if the metal of the base is hard enough.

The threaded shaft 45 can extend above and below the pivot block, and can extend a greater distance below the pivot block as shown in some cases. The threaded shaft also can extend downward into the recess 21. The threads 45T of the threaded shaft 45 can extend to an area of the lock block corresponding to a bore 30B defined by the lock block, but optionally those threads and the threaded shaft do not directly contact the lock block or the bore as described below. The threaded shaft also can extend above the pivot block as shown in FIGS. 1-4, and that upper part of the threaded shaft 45 can be nonrotatably, fixedly secured to the thumb lever 40. More particularly, the threaded shaft upper part can extend into a bore 40B of the thumb lever and can be pinned there to the lever via a pin 41P or set screw that fixes or secures the threaded shaft 45 to the thumb lever. Although referred to as a thumb lever, the lever 40 can be any elongated lever, bar, or member that can facilitate rotation of the threaded shaft when moved or rotated as described below.

Figure 5:
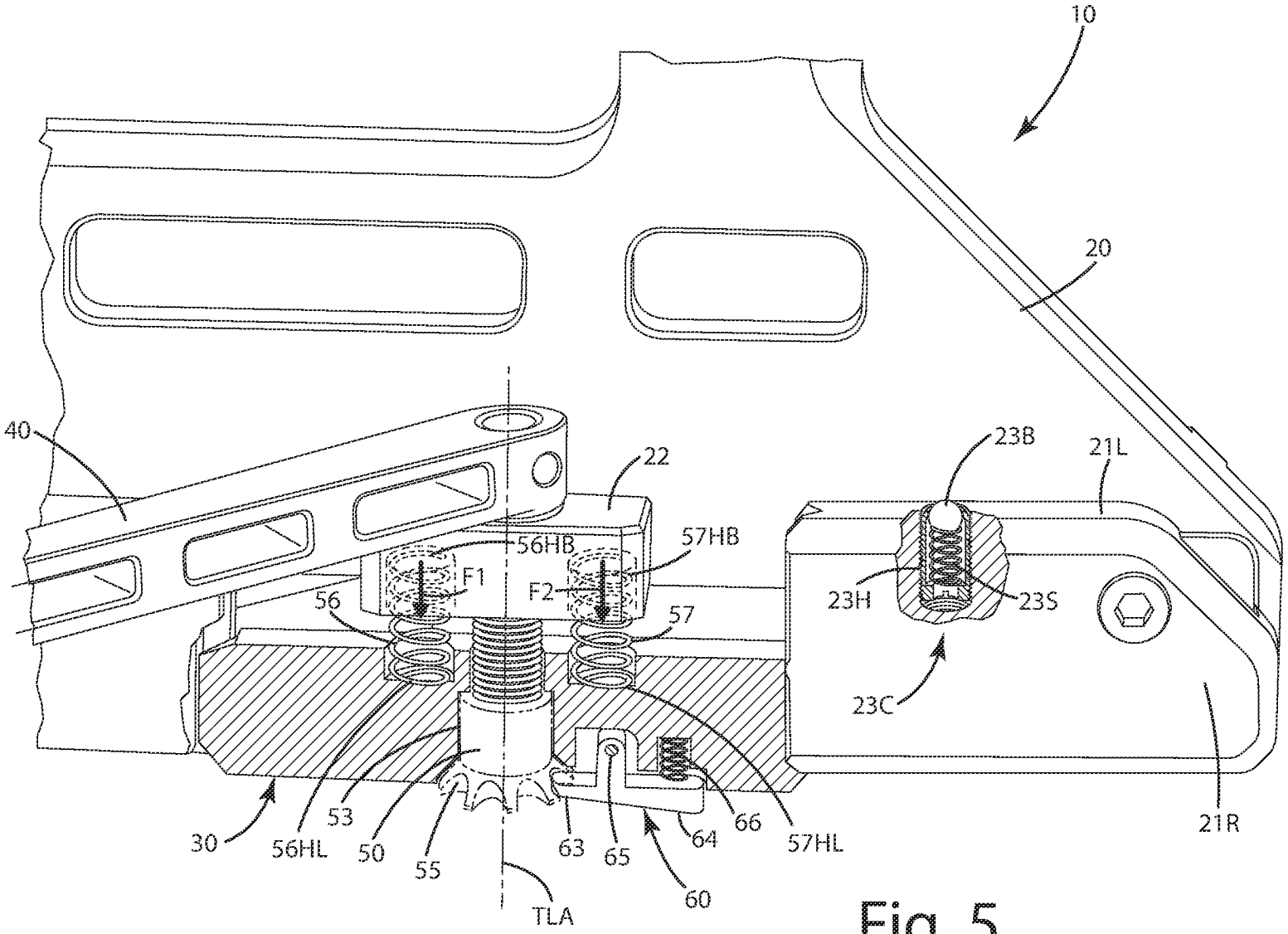
FIG. 5 is a side section view of the lock block and base disengaging a firearm rail in an open mode to the mount that can be removed from the firearm rail.
Figure 6:
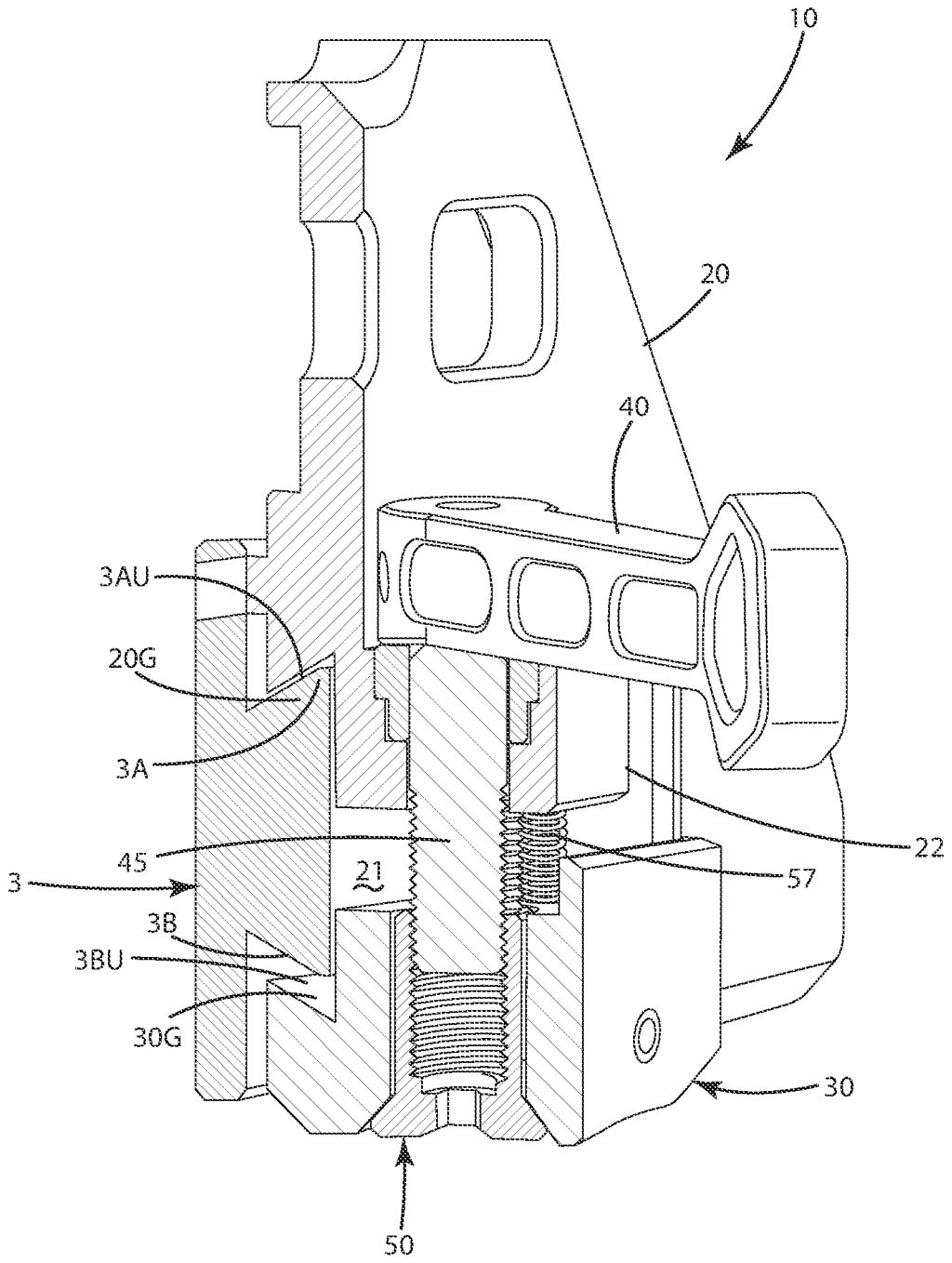
FIG. 6 is a front section view thereof.

The thumb lever 40 can extend rearward from the threaded shaft and pivot block a distance, and optionally can extend over a ledge 21L of the base adjacent and/or above the rear part 21R. As shown in FIG. 5, that ledge can include a ball catch 23 that can engage a detent 40C in the thumb lever to hold the thumb lever in the retracted position shown in FIGS. 1-3, when the lock block is in a closed mode as described below. The ball catch can include a housing 23H in which a spring 23S is disposed and pushes a ball 23B to a raised position. With sufficient force on the lever, the ball 23B can retract slightly into the housing 23H to allow the detent 40C to clear the ball and be released for movement or rotation relative to the pivot block and or base 20 in general. In this manner, the thumb lever can be extended to an extended mode as shown in FIGS. 5-6 when the lock block is in an open mode to remove or adjust the base relative to the firearm.

The base 20 as shown in FIGS. 3-4 can include an inner side 201. The inner side can include a slot, groove or channel 20G. That slot can be configured to receive a portion of the firearm rail 3. In particular, the slot 20G can receive the first part 3A of the firearm rail, which can be in the shape of a tapered wedge having an undercut 3AU into which part of the base adjacent the channel 20G fits. The firearm rail 3 also can include a second part 3B, which can also be in the shape of a tapered wedge having a similar undercut 3BU into which a rail flange 30R of the lock block 30 fits as described below to clamp the firearm rail between the base and the lock block. The lock block 30 can define a corresponding slot, groove or channel 30G into which the part 3BU of the firearm rail can fit. Generally, the slot 20G and the slot 30G, and the surrounding material of the base and lock block, are configured to clamp against the firearm rail when the lock block is in the closed mode as described below.

As mentioned above, the mount 10 includes the lock block 30 movably disposed in the recess 21 of the base 20, optionally between the forward and rearward parts of the base, and below the pivot block of the base. The lock block shown in FIGS. 2-4 can include a bore 30B that extends generally from an upper surface of the block to a lower surface of the block. The bore 30B can be smooth as shown, or can include other contours, but optionally is not threaded. The bore can include a contoured tapered or frustoconical entry 30BT near the lower surface.

The bore can be configured to receive a threaded element 50 therein. The threaded element can include a sleeve 53 and a head 55. The sleeve 53 can include a threaded bore 50B with threads 50T therein. The outside of the sleeve and head, however, are not threaded and can free spin inside the bore. These threads can threadably receive the threads 45T of the threaded shaft 45 so that the threaded element can thread on and off the threaded shaft upon directional rotation of the threaded shaft. The threaded element 50 also can define a drive feature 59 which can be a hole or other feature configured to receive a tool. The drive hole can mate with the tool, which can be a hex key drive, a TORX drive, a star drive, Phillips or flat head screw drive, or some other drive. The tool 59T can be used to rotate the threaded element onto or off the threaded shaft to set the initial clamping force of the mount on the firearm rail as described below.

The threaded element 50 as shown can be in the form of a keps nut having multiple notches 50N as shown in FIG. 3. These notches can be formed or defined in the head 55. The notches can be equally radially spaced about the axis TLA and/or the drive feature 59 of the threaded element. The notches can be configured to circumferentiate the drive feature and can vary in number. Optionally, the notches can be of a depth D1 that is less than a diameter D of the threaded element head 55. The particular depth can be selected to accommodate the lock element 60.

Figure 7:
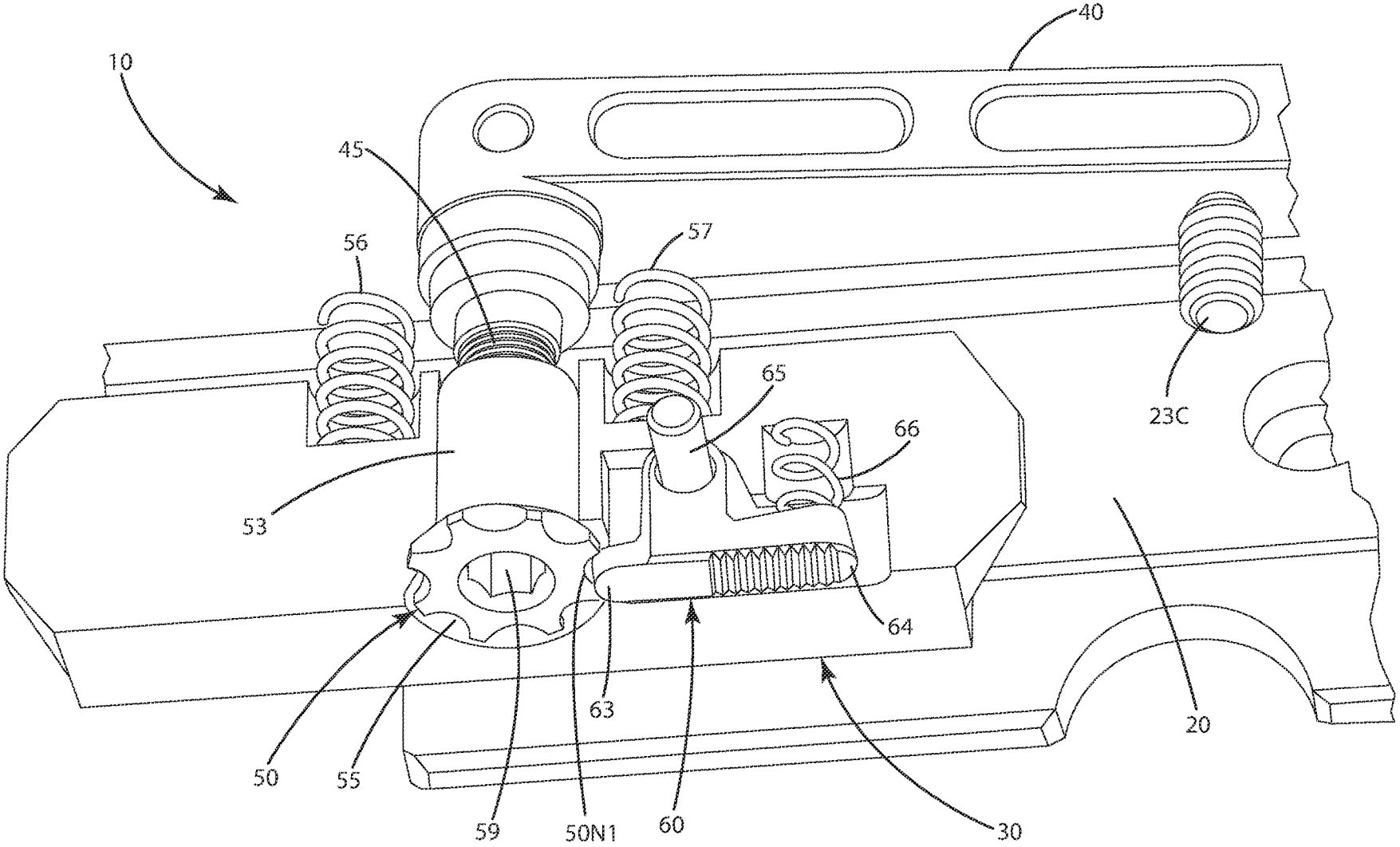
FIG. 7 is a bottom section view of a toggle lock engaging the threaded element so the threaded element will not rotate.
Figure 8:
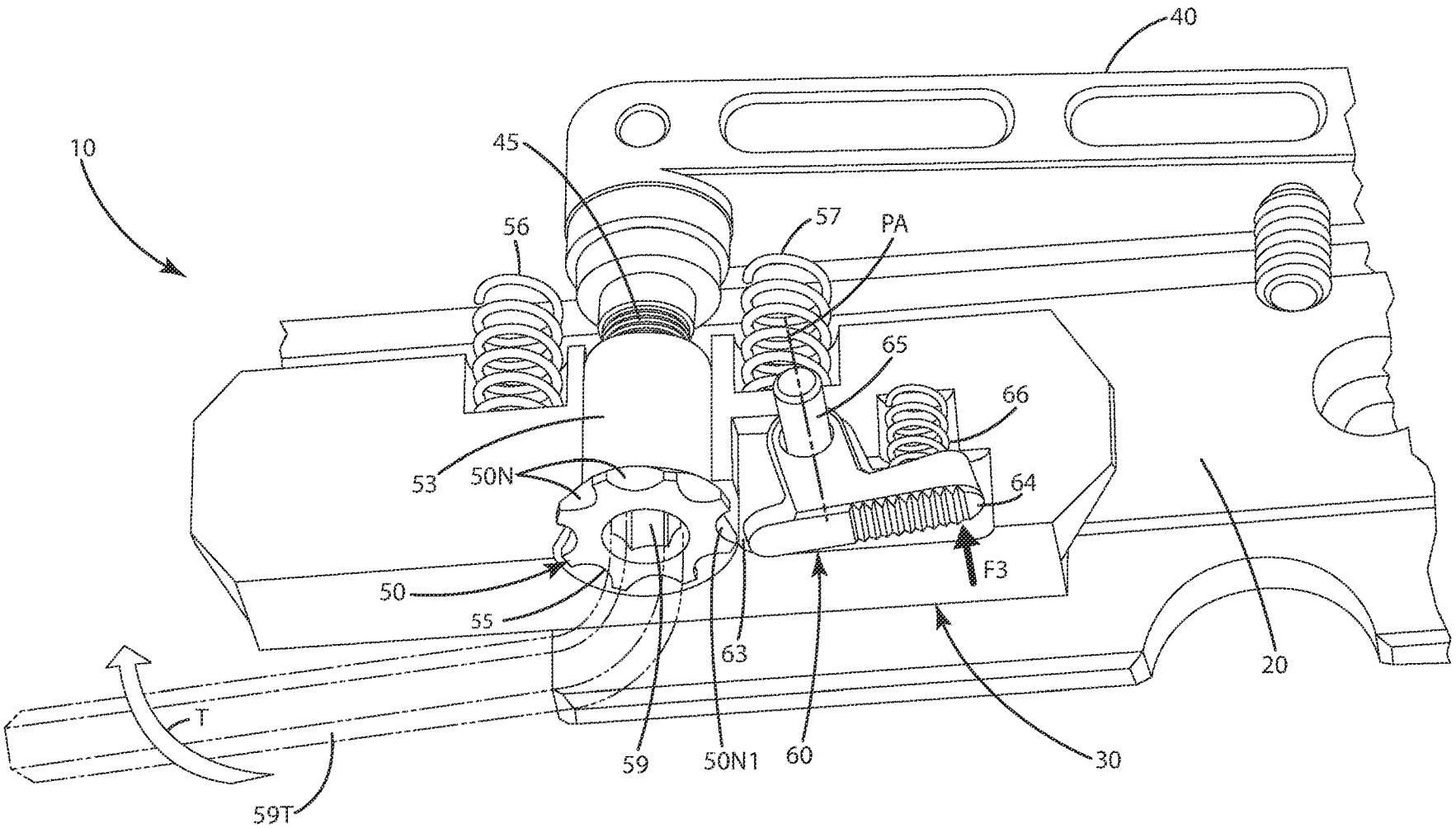
FIG. 8 is a bottom section view of a toggle lock depressed to disengage the threaded element so the threaded element can be tightened with a tool to adjust the clamping force of the lock block and base on a firearm rail.

The lock element 60 as shown in FIGS. 3, 7 and 8 can be in the form of a toggle lock pivotally joined with the lock block 30. The toggle lock 60 can include a toggle engagement surface or a lock surface, shown as a tooth 63 that selectively engages the threaded element 50 to selectively, rotatably constrain the threaded element in the lock block 30. This constraint can prevent the keps nut from rotating in the bore 30B, even while the threaded shaft 45 rotates in the bore 50B of the threaded element to thread the keps nut onto the threads of the threaded shaft. The toggle lock can include an engagement button 63 opposite the tooth 63. A spring 66 can be biased against the button 63 to urge it to the position shown in FIG. 7, where the toggle lock is in a locked mode to prevent rotation of the threaded element in the bore. When the toggle lock is depressed with a force F3, it can pivot about the pivot pin 65 and the toggle lock axis PA, which can be perpendicular to the longitudinal axis TLA of the bore and threaded shaft. When the force is applied, the tooth 63 can exit the notch 50N1 so that the threaded element can be rotated. Generally the sleeve and tapered head can be rotated in the bore of the lock block when the lock element is disengaged from the plurality of notches. The threaded element 50 can be rotated with the tool 59T to tighten the threaded element relative to the threaded shaft, which in turn moves the lock block to reduce the space S1 between the lock block groove 30G and the base groove 20G. This can effectively tighten the mount, for example, the lock block and the base, relative to the firearm rail 3, before the throw lever is moved to a closed mode to finally tighten and clamp the mount to the firearm rail. After the threaded element is threaded on the threaded shaft a suitable amount, to set the clamping force on the firearm rail, the force F3 can be removed, in which case the spring 66 rotates the toggle lock 60 so that the lock surface or tooth 63 again engages the notches 50N. Upon this engagement, the threaded element is prevented from rotating in the bore of the lock block.

As noted above, the lock block 30 can be movably disposed in the recess 21 of the mount 10. One or more springs 56, 57 also can be disposed in the recess or otherwise can engage the lock block. Generally, these springs can be configured to bias the lock block away from the firearm rail when the lock block is in an open mode shown in FIGS. 5 and 6. The spring 56 can be seated and/or trapped in holes 56HL of the lock block and 56HB of the base, for example, the pivot block 22. The spring 57 can be seated and/or trapped in holes 57HL of the lock block and 57HB of the base. The holes can trap and or guide the springs, and can provide recesses into which the springs retract. Although shown as coil springs, the springs 56 and 57 can be replaced with any bias element, leaf spring, rubber or elastomeric material, elastic or compression element or the like, all referred to as springs herein. Optionally, the springs 56 and 57 can be symmetrically disposed on opposite sides of longitudinal axis TLA of the bore 30B. This can be so that the springs exert relatively balanced forces F1 and F2 against the lock block to evenly move it in the recess, so the lock block does not tilt and/or bind in the recess. Of course, where included, the alignment guides also can help in maintaining smooth movement of the lock block.

A method of using the mount 10 of the current embodiment will now be described. In general, the mount 10 can be applied to a firearm rail 3 of the firearm 2. The rail 3 can be inserted in the grooves 20G and 30G of the base and lock block. The mount can be slid along the rail until the accessory rail 25 is properly positioned over the top 2U of the firearm, in a location satisfactory for mounting the accessory. The toggle lock can be depressed with a force F3 as shown in FIG. 8 so the lock is in an unlocked mode and the threaded element 50 can be rotated due to the lock surface 63 disengaging the notches 50N. A tool 59T can be mated with the drive feature 59 and turned. This turns the threaded element 50 so it threads on the threaded shaft. The threaded element also pulls the lock block upward toward the pivot block due to the head 55 engaging the tapered part of the bore. The lock block can be guided by the guides in the recess so it does not tilt or bind in the recess, and can move in a linear manner. The springs depress when the lock block is moved up. The grooves 20G and 30G also close in on the firearm rails. The lock block and base can be snugged against the firearm rail to secure the mount to the firearm. After this setting of the base and the lock block, the toggle lock can be released by removing force F3. The tooth 63 can engage a notch so that the threaded element is again rotationally constrained in the bore 30B.

To remove the mount 10 from the firearm rail, a user can engage the thumb lever 40 and rotate it from the position over the ledge 21L in FIG. 4 to the position shown in FIGS. 5-6. In so doing, the ball catch 23C is depressed sufficiently to allow the thumb lever to rotate forward. As it does, the threaded shaft 45 also rotates in unison. The threaded shaft 45 rotates relative to the threaded element 50, so that the threaded element loosens off the threads 45T of the shaft. The head 53 of the threaded element, held from rotating by the toggle lock 60 in the locked mode, moves away from the pivot block 22. As this occurs, the lock block 30 is urged away from the pivot block 22 by way of the springs 56, 57 urging the lock block 30 to do so. The guides along the lock block registered in the grooves allow the lock block to move in an un-tilted or nonbinding manner. When the lock block moves, the space S between the grooves 20G and 30G increases so that the clamping forces by the lock block and the base are removed partially or fully from the firearm rail 3. When this occurs, the user can slide the mount along the rail and remove the mount from the firearm or adjust the position of the mount relative to the firearm rail and firearm.

The various components and features of the embodiments herein can take on a variety of aesthetic forms, shapes and sizes. Although a particular component or feature can have a function, that feature can be expressed in different aesthetic manners to form an artistic design and/or purely ornamental design.

Directional terms, such as "vertical," "horizontal," "top," "bottom," "upper," "lower," "inner," "inwardly," "outer" and "outwardly," are used to assist in describing the invention based on the orientation of the embodiments shown in the illustrations. The use of directional terms should not be interpreted to limit the invention to any specific orientation(s).

In addition, when a component, part or layer is referred to as being "joined with," "on," "engaged with," "adhered to," "secured to," or "coupled to" another component, part or layer, it may be directly joined with, on, engaged with, adhered to, secured to, or coupled to the other component, part or layer, or any number of intervening components, parts or layers may be present. In contrast, when an element is referred to as being "directly joined with," "directly on," "directly engaged with," "directly adhered to," "directly secured to," or "directly coupled to" another element or layer, there may be no intervening elements or layers present. Other words used to describe the relationship between components, layers and parts should be interpreted in a like manner, such as "adjacent" versus "directly adjacent" and similar words. As used herein, the term "and/or" includes any and all combinations of one or more of the associated listed items.

The above description is that of current embodiments of the invention. Various alterations and changes can be made without departing from the spirit and broader aspects of the invention as defined in the appended claims, which are to be interpreted in accordance with the principles of patent law including the doctrine of equivalents. This disclosure is presented for illustrative purposes and should not be interpreted as an exhaustive description of all embodiments of the invention or to limit the scope of the claims to the specific elements illustrated or described in connection with these embodiments. For example, and without limitation, any individual element(s) of the described invention may be replaced by alternative elements that provide substantially similar functionality or otherwise provide adequate operation. This includes, for example, presently known alternative elements, such as those that might be currently known to one skilled in the art, and alternative elements that may be developed in the future, such as those that one skilled in the art might, upon development, recognize as an alternative. Further, the disclosed embodiments include a plurality of features that are described in concert and that might cooperatively provide a collection of benefits. The present invention is not limited to only those embodiments that include all of these features or that provide all of the stated benefits, except to the extent otherwise expressly set forth in the issued claims. Any reference to claim elements in the singular, for example, using the articles "a," "an," "the" or "said," is not to be construed as limiting the element to the singular. Any reference to claim elements as "at least one of X, Y and Z" is meant to include any one of X, Y or Z individually, any combination of X, Y and Z, for example, X, Y, Z; X, Y; X, Z; Y, Z, and/or any other possible combination together or alone of those elements, noting that the same is open ended and can include other elements.

What is claimed is:

1. A mount for removable attachment to a firearm rail, the mount comprising:

a base removably mountable on a firearm rail, the base joined with an accessory mounting rail configured to extend along a portion of the firearm, the base defining a recess bounded by a first sidewall, a second opposing sidewall and a bottom wall;

a lock block slidably disposed in the recess of the base, a spring disposed between the bottom wall and the lock block, the spring configured to bias the lock block away from the bottom wall and the firearm rail when the lock block is in an open mode, the lock block defining a bore;

a thumb lever joined with a threaded shaft, the thumb lever extending along a portion of the base; and a threaded element that threadably engages the threaded shaft, the threaded element being selectively, rotatably constrained in the lock block, the threaded shaft extending in the bore of the lock block, with the threaded element located between the bore and the threaded shaft so that the threaded shaft does not directly engage the lock block, wherein the lock block is operable in a closed mode, in which the lock block engages the firearm rail to secure the base to the firearm rail and secure the accessory mounting rail in a fixed position relative to the firearm, and in an open mode, in which the lock block moves relative to the firearm rail so that the base and lock block can be removed from the firearm rail, wherein rotation of the thumb lever rotates the threaded shaft relative to the threaded element so that the lock block is urged away from the bottom wall via the spring in the open mode, wherein the accessory mounting rail is supported distal from the lock block so that an accessory is mountable relative to the accessory mounting rail and thus the base, the accessory mounting rail being distal and separate from the firearm rail when the mount is installed on the firearm.

2. The mount of claim 1 comprising:

a ledge joined with the base and disposed adjacent the thumb lever when the lock block is in the closed mode;

a ball catch that engages the thumb lever to secure the thumb lever in a retracted mode when the lock block is in the closed mode, the ball catch including a ball and another spring located in another bore defined by the ledge.

3. The mount of claim 1, wherein the threaded element is a keps nut including a sleeve and a tapered head that is disposed in a tapered portion of the bore.

4. The mount of claim 3, wherein the keps nut includes a sleeve extending from the tapered head, wherein the keps nut includes a plurality of notches and a drive feature, wherein the plurality of notches circumferentiate the drive feature.

5. A mount for removable attachment to a firearm rail, the mount comprising:

a base removably mountable on a firearm rail, the base joined with an accessory mounting rail configured to extend along a portion of the firearm, the base defining a recess bounded by a first sidewall, a second opposing sidewall and a bottom wall;

a lock block slidably disposed in the recess of the base, a spring disposed between the bottom wall and the lock block, the spring configured to bias the lock block away from the bottom wall and the firearm rail when the lock block is in an open mode, the lock block defining a bore;

a thumb lever joined with a threaded shaft, the thumb lever extending along a portion of the base;

a threaded element that threadably engages the threaded shaft, the threaded element being selectively, rotatably constrained in the lock block, the threaded shaft extending in the bore of the lock block, with the threaded element located between the bore and the threaded shaft so that the threaded shaft does not directly engage the lock block; and a toggle lock pivotally joined with the lock block, the toggle lock including a toggle engagement surface that selectively engages the threaded element to selectively, rotatably constrain the threaded element in the lock block, wherein the lock block is operable in a closed mode, in which the lock block engages the firearm rail to secure the base to the firearm rail and secure the accessory mounting rail in a fixed position relative to the firearm, and in an open mode, in which the lock block moves relative to the firearm rail so that the base and lock block can be removed from the firearm rail, wherein rotation of the thumb lever rotates the threaded shaft relative to the threaded element so that the lock block is urged away from the bottom wall via the spring in the open mode.

6. The mount of claim 5, wherein the toggle lock is operable in an unlocked mode and the locked mode, wherein in the locked mode, the toggle lock prevents rotation of the threaded element in the bore, wherein in the unlocked mode, the toggle lock allows rotation of the threaded element in the bore.

7. The mount of claim 1 comprising:

an L-shaped leg extending upward from the base, the leg configured to extend over a portion of the firearm, wherein the accessory mounting rail is joined with an upper portion of the leg so that the accessory rail extends along a longitudinal axis of the firearm.

8. The mount of claim 7, wherein the base defines a first slot, wherein the lock block defines a second slot, wherein the first slot and the second slot are configured to clamp against the firearm rail when the lock block is in the closed mode.

9. The mount of claim 1, wherein the lock block includes a first block guide and a second block guide disposed at opposing ends of the lock block, wherein the first block guide registers with a corresponding first base guide, wherein the second block guide registers with a corresponding second base guide, wherein the first and second block guides registered with the first and second base guides align the lock block in the recess so that the lock block can slide within the recess in an aligned manner therewith.

10. The mount of claim 1, wherein the accessory mounting rail is a longitudinal picatinny rail that is parallel to the longitudinal axis of the firearm.

11. A mount for removable attachment to a firearm rail, the mount comprising:

a base removably mountable on a firearm rail disposed on a lateral side of the firearm, the base joined with a leg configured to project upward along the lateral side of the firearm, the base defining a recess;

an accessory mounting rail joined with the leg and protruding outward therefrom so that the accessory mounting rail extends over an upper portion of the firearm and is aligned along a longitudinal axis of the firearm the accessory mounting rail configured to receive an accessory mounted thereto, thereby mounting the accessory relative to the base but distal from the firearm rail disposed on the lateral side of the firearm;

a lock block movably disposed in the recess of the base, the lock block defining a bore;

a spring disposed between the base and the lock block, the spring configured to bias the lock block away from the firearm rail when the lock block is in an open mode;

a thumb lever joined with a threaded shaft; and a threaded element that threadably engages the threaded shaft, the threaded element being selectively, rotatably constrained in the lock block, the threaded element located between the bore and the threaded shaft so that the threaded shaft does not directly engage the lock block, wherein rotation of the thumb lever rotates the threaded shaft relative to the threaded element so that the lock block is urged away from the firearm rail via the spring so that the mount can be detached from the firearm rail in the open mode.

12. A mount for removable attachment to a firearm rail, the mount comprising:

a base removably mountable on a firearm rail disposed on a lateral side of the firearm, the base joined with a leg configured to project upward along the lateral side of the firearm so that an accessory mounting rail joined with the leg is configured to extend over an upper portion of the firearm, the base defining a recess;

a lock block movably disposed in the recess of the base, the lock block defining a bore;

a spring disposed between the base and the lock block, the spring configured to bias the lock block away from the firearm rail when the lock block is in an open mode;

a thumb lever joined with a threaded shaft;

a threaded element that threadably engages the threaded shaft, the threaded element being selectively, rotatably constrained in the lock block, the threaded element located between the bore and the threaded shaft so that the threaded shaft does not directly engage the lock block; and a toggle lock joined with the lock block and pivotable about a toggle lock axis, wherein the lock axis is perpendicular to a longitudinal axis of the threaded shaft, wherein rotation of the thumb lever rotates the threaded shaft relative to the threaded element so that the lock block is urged away from the firearm rail via the spring so that the mount can be detached from the firearm rail in the open mode.

13. The mount of claim 11, wherein the accessory mounting rail is a longitudinal picatinny rail that is parallel to the longitudinal axis of the firearm.

14. The mount of claim 11, wherein the lock block is guided in the recess in a linear manner via opposing guide elements disposed at a front end and a rear end of the recess.

15. The mount of claim 11, wherein the threaded element is a keps nut having a plurality of notches, wherein a lock element is selectively moveable in and out of a first notch when the first notch is aligned with the lock element.

16. A mount for removable attachment to a firearm rail, the mount comprising:

a base removably mountable on a firearm rail disposed on a lateral side of the firearm, the base joined with a leg configured to project upward along the lateral side of the firearm so that an accessory mounting rail joined with the leg is configured to extend over an upper portion of the firearm, the base defining a recess;

a lock block movably disposed in the recess of the base, the lock block defining a bore;

a spring disposed between the base and the lock block, the spring configured to bias the lock block away from the firearm rail when the lock block is in an open mode;

a thumb lever joined with a threaded shaft;

a threaded element that threadably engages the threaded shaft, the threaded element being selectively, rotatably constrained in the lock block, the threaded element located between the bore and the threaded shaft so that the threaded shaft does not directly engage the lock block; and a toggle lock pivotally joined with the lock block and biased to a locked mode in which a lock surface is disposed in one of a plurality of notches to prevent rotation of the threaded element in the bore, wherein rotation of the thumb lever rotates the threaded shaft relative to the threaded element so that the lock block is urged away from the firearm rail via the spring so that the mount can be detached from the firearm rail in the open mode.

17. A method of operating a mount, the method comprising:

providing a base joined with an accessory mounting rail, the base defining a recess with a lock block movably disposed in the recess, the lock block defining a bore within which a threaded element is selectively, rotatably constrained;

rotating a thumb lever joined with the base so that a threaded shaft, joined with the thumb lever, rotates relative to the threaded element; and moving the lock block away from a firearm rail via a spring so that the mount can be detached from the firearm rail in an open mode, wherein the firearm rail is separate and distal from the accessory mounting rail, wherein the accessory mounting rail is configured to receive an accessory mounted thereto, thereby mounting the accessory relative to the base but distal from the firearm rail.

18. The method of claim 17, comprising:

mounting an accessory to the accessory mounting rail, which is in the form of a longitudinal picatinny rail.

19. A method of operating a mount, the method comprising:

providing a base joined with an accessory mounting rail, the base defining a recess with a lock block movably disposed in the recess, the lock block defining a bore within which a threaded element is selectively, rotatably constrained;

rotating a thumb lever joined with the base so that a threaded shaft, joined with the thumb lever, rotates relative to the threaded element;

moving the lock block away from a firearm rail via a spring so that the mount can be detached from the firearm rail in an open mode; and engaging a toggle lock with a notch of the threaded element so that the threaded element is rotatably constrained in the bore, unable to rotate.

20. The method of claim 17, wherein, before the rotating step, the firearm rail is disposed on a lateral side of the firearm, and the base is joined with a leg that projects upward along the lateral side of the firearm so that an accessory mounting rail joined with the leg extends over an upper portion of the firearm to provide a location for mounting an accessory over the upper portion of the firearm.

* * * * *